US008507170B2

(12) United States Patent
Takahashi et al.

(10) Patent No.: US 8,507,170 B2
(45) Date of Patent: Aug. 13, 2013

(54) IMAGE-FORMING METHOD AND IMAGE-FORMING APPARATUS

(75) Inventors: Tooru Takahashi, Mishima (JP); Katsuhisa Yamazaki, Numazu (JP); Syuhei Moribe, Numazu (JP); Daisuke Yoshiba, Suntou-gun (JP); Masami Fujimoto, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/001,052

(22) PCT Filed: Jul. 24, 2009

(86) PCT No.: PCT/JP2009/063619

§ 371 (c)(1), (2), (4) Date: Dec. 23, 2010

(87) PCT Pub. No.: WO2010/010971

PCT Pub. Date: Jan. 28, 2010

(65) Prior Publication Data

US 2011/0097655 A1 Apr. 28, 2011

(30) Foreign Application Priority Data

Jul. 25, 2008 (JP) ..... 2008-191896

(51) Int. Cl.
*G03G 13/08* (2006.01)

(52) U.S. Cl.
USPC ..... 430/122.5; 430/122.51; 430/123.4; 430/123.41; 430/123.42; 430/123.5

(58) Field of Classification Search
USPC ..... 430/122.5, 122.51, 123.4, 123.41, 430/123.42, 123.5
See application file for complete search history.

(56) References Cited

U.S. PATENT DOCUMENTS 4,569,855 A 2/1986 Matsuda et al.
4,683,144 A 7/1987 Nishimura et al.

(Continued)

FOREIGN PATENT DOCUMENTS

EP 1 207 429 A2 5/2002
EP 1 223 472 A2 7/2002

(Continued)

OTHER PUBLICATIONS

Diamond, "The Handbook of Imaging Materials," Marcel Dekker, NY, NY 1991, 10th printing.*

(Continued)

*Primary Examiner* — Peter Vajda
(74) *Attorney, Agent, or Firm* — Fitzpatrick, Cella, Harper & Scinto

(57) ABSTRACT

An image-forming method includes forming an electrostatic image on an electrostatic image bearing member which has been charged; developing the electrostatic image to form a toner image; transferring the toner image on the electrostatic image bearing member with or without mediating an intermediate transferring member onto a transfer material; and fixing the toner image on the transfer material. The electrostatic image bearing member is a photosensitive member obtained by sequentially laminating a photoconductive layer and a surface layer formed of hydrogenated amorphous silicon carbide, and a sum of an atomic density of silicon atoms and an atomic density of carbon atoms in the surface layer of the photosensitive member is $6.60\times10^{22}$ atoms/cm$^3$ or more. The toner has a binder resin and magnetic iron oxide particles, and the magnetic iron oxide particles contain Fe(2+) at a content of 20.0 mass % or more and 25.0 mass % or less.

6 Claims, 2 Drawing Sheets

(56) References Cited

U.S. PATENT DOCUMENTS

| | | | | |
|---|---|---|---|---|
| 4,683,145 | A | 7/1987 | Nishimura et al. | |
| 4,683,146 | A | 7/1987 | Hirai et al. | |
| 4,683,147 | A | 7/1987 | Eguchi et al. | |
| 5,087,542 | A | 2/1992 | Yamazaki et al. | |
| 5,112,709 | A | 5/1992 | Yamazaki et al. | |
| 5,358,811 | A | 10/1994 | Yamazaki et al. | |
| 5,392,098 | A | 2/1995 | Ehara et al. | |
| 5,455,138 | A | 10/1995 | Okamura et al. | |
| 5,480,750 | A | 1/1996 | Kawada et al. | |
| 5,582,944 | A | 12/1996 | Yamamura et al. | |
| 5,624,776 | A * | 4/1997 | Takei et al. | 430/56 |
| 5,817,181 | A | 10/1998 | Okamura et al. | |
| 5,849,446 | A | 12/1998 | Hashizume et al. | |
| 5,976,745 | A | 11/1999 | Aoki et al. | |
| 6,183,930 | B1 | 2/2001 | Ueda et al. | |
| 6,233,417 | B1 | 5/2001 | Nakayama et al. | |
| 6,238,832 | B1 | 5/2001 | Hashizume et al. | |
| 6,322,943 | B1 | 11/2001 | Aoki et al. | |
| 6,383,637 | B1 | 5/2002 | Misawa et al. | |
| 6,531,253 | B2 | 3/2003 | Ehara et al. | |
| 7,060,406 | B2 | 6/2006 | Kawamura et al. | |
| 7,157,197 | B2 | 1/2007 | Aoki et al. | |
| 7,255,969 | B2 | 8/2007 | Kojima et al. | |
| 7,498,110 | B2 | 3/2009 | Taniguchi et al. | |
| 2002/0115011 | A1 | 8/2002 | Komoto et al. | |
| 2002/0150831 | A1 | 10/2002 | Ehara et al. | |
| 2004/0023140 | A1 | 2/2004 | Kawamura et al. | |
| 2008/0286676 | A1 * | 11/2008 | Yoshiba et al. | 430/106.2 |
| 2010/0021835 | A1 | 1/2010 | Akiyama et al. | |
| 2010/0021836 | A1 | 1/2010 | Ozawa et al. | |
| 2010/0021837 | A1 | 1/2010 | Ozawa et al. | |

FOREIGN PATENT DOCUMENTS

| | | | |
|---|---|---|---|
| JP | 58-080656 | A | 5/1983 |
| JP | 04-093864 | A | 3/1992 |
| JP | 04-338971 | A | 11/1992 |
| JP | 05-018471 | A | 1/1993 |
| JP | 06-102686 | A | 4/1994 |
| JP | 06-250425 | A | 9/1994 |
| JP | 07-043921 | A | 2/1995 |
| JP | 07-175244 | A | 7/1995 |
| JP | 08-022229 | A | 1/1996 |
| JP | 08-211641 | A | 8/1996 |
| JP | 11-161120 | A | 6/1999 |
| JP | 2000-003055 | A | 1/2000 |
| JP | 03-124841 | A | 1/2001 |
| JP | 2001-002426 | A | 1/2001 |
| JP | 2002-123020 | A | 4/2002 |
| JP | 2002-148907 | A | 5/2002 |
| JP | 2002-207305 | A | 7/2002 |
| JP | 2002-229303 | A | 8/2002 |
| JP | 2002-296987 | A | 10/2002 |
| JP | 2003-107766 | A | 4/2003 |
| JP | 2003-107767 | A | 4/2003 |
| JP | 2003-337437 | A | 11/2003 |
| JP | 2004-077650 | A | 3/2004 |
| JP | 2004-126347 | A | 4/2004 |
| JP | 2004-133397 | A | 4/2004 |

OTHER PUBLICATIONS

Notification of Transmittal of the International Search Report and the Written Opinion of the International Searching Authority dated Nov. 4, 2009, in related corresponding PCT International Application No. PCT/JP2009/063619.

U.S. Appl. No. 13/056,734, filed Jan. 31, 2011, Kazuyoshi Akiyama et al.

U.S. Appl. No. 12/949,015, filed Nov. 18, 2010, Kazuyoshi Akiyama et al.

U.S. Appl. No. 12/949,053, filed Nov. 18, 2010, Tomohito Ozawa et al.

U.S. Appl. No. 12/952,311, filed Nov. 23, 2010, Yuu Nishimura et al.

U.S. Appl. No. 12/943,977, filed Nov. 11, 2010, Tomohito Ozawa et al.

* cited by examiner

IMAGE-FORMING METHOD AND IMAGE-FORMING APPARATUS

TECHNICAL FIELD

The present invention relates to an image-forming method and an image-forming apparatus each intended for the visualization of an electrostatic image in electrophotography.

BACKGROUND ART

Performance requested of image-forming systems and toner has started to become additionally sophisticated in recent years in association with widespread use of image-forming apparatuses such as a copying machine and a printer. To be specific, an improvement in quality of an image formed with any such system or toner and an increase in speed at which the image is formed have been requested, and furthermore, the kinds of transfer materials to be used have been covering a broad spectrum: a transfer material such as coat paper as well as plain paper has started to be used.

Of the image-forming systems, a one-component developing system is preferably used as a developing system because a developing device to be used is of a simple structure, causes a small amount of trouble, has a long lifetime, and can be easily maintained.

Several approaches have been known about the one-component developing system, and a jumping developing method is one of them. The jumping developing method is a method involving: causing toner charged by triboelectric charging to fly onto a photosensitive member with a developing bias; and visualizing an electrostatic image on the photosensitive member as a toner image.

In this case, the toner, which has a proper charge quantity, follows the developing bias to reciprocate between the photosensitive member and a developing sleeve. As a result, the toner image is formed in an image portion, and the toner flying toward a non-image portion returns to the developing sleeve, whereby a clear image is obtained.

In addition, the following approach has been employed as one transfer step: a voltage opposite in polarity to that of the toner is applied to a transfer material, and the toner image on the photosensitive member is caused to fly toward the transfer material by a Coulomb force between the toner and the transfer material.

In order that the improvement in image quality and the increase in speed requested in the market may be achieved in such image-forming system as described above, a photosensitive member having the following characteristics is needed: a clear electrostatic image can be formed on the photosensitive member, and a desired electric field can be formed between the photosensitive member and the developing sleeve, and between the photosensitive member and the transfer material in a developing zone and a transfer zone.

Further, a toner having good charging stability is needed in order that the electrostatic image formed on the photosensitive member may be uniformly compensated.

When a photosensitive member on which an electrostatic image cannot be clearly formed and a toner having low charging stability are used, an electric field to be formed in the developing zone or transfer zone cannot be the desired electric field, and furthermore, the electric potential of the toner image on the photosensitive member is apt to be nonuniform. As a result, an image defect such as scattering or tailing occurs.

For example, a magnetic iron oxide particle is one factor for determining the charge quantity and charging stability of toner. The magnetic iron oxide particle exposed to the surface of the toner is expected to serve as a leak point for charging. In particular, it has been known that FeO in the magnetic iron oxide particle has a function of reducing the resistance of the magnetic iron oxide particle. It has also been known that the content of FeO in the magnetic iron oxide particle largely contributes to the charging stability of the toner.

For example, Patent Document 1 proposes a magnetic iron oxide particle having the following characteristic: an FeO amount in a layer from the surface of the particle to a thickness corresponding to 3.5% of the radius of the particle is specified to a low value so that charge leak may be suppressed, and a saturation time for the triboelectric charging of a toner containing the particle may be shortened. However, the charging stability of the toner may be insufficient because the FeO amount is small.

In addition, Patent Document 2 proposes a magnetic iron oxide particle that imparts good charging stability to toner irrespective of an environment under which the toner is used by the following procedure: a surface FeO amount is specified for three stages of an iron element dissolution ratio, i.e., 5%, 10%, and 15% so that an FeO amount may be specified to a large value.

In addition, with regard to a photosensitive member, a photosensitive member using hydrogenated amorphous silicon carbide (hereinafter referred to as "a-SiC:H") in its surface layer is preferably used in a high-speedmachine requested to show high durable stability and high reliability. The photosensitive member using a-SiC:H in its surface layer has the following advantages: the photosensitive member has a high surface hardness, and is excellent in durability and heat resistance. Accordingly, the photosensitive member shows nearly no deterioration due to repeated use, so the photosensitive member has been expected to provide the following merit: clear electrostatic images can be formed on the photosensitive member over a long time period.

However, the a-SiC:H surface layer involves, for example, the following problem: a corona product typified by $NO_X$ or $SO_X$ adheres to the surface layer so as to be one cause for the collapse of an electrostatic image. When the corona product adheres to the surface of the photosensitive member, the corona product captures moisture in the air, reduces the resistance of the surface, and causes the deletion of the electrostatic image. A general measure against the foregoing is, for example, a method involving attaching a heater to the photosensitive member to reduce the amount of moisture adhering to the surface. In addition, Patent Document 3 proposes a photosensitive member having the following characteristic: a hydrophobic fluorine atom is incorporated into the surface protective layer of the photosensitive member so that the reactivity of the surface protective layer with a corona product or water may be reduced.

In addition, the a-SiC:H surface layer has a large number of dangling bonds, and the dangling bonds are known to capture photo carriers to inhibit the formation of a clear electrostatic image. In view of the foregoing, Patent Document 4 proposes a method of providing a photosensitive member having a small number of dangling bonds, the method having the following characteristics: the method is a method of forming a photosensitive member by plasma CVD in which a plasma density is specified, and a photosensitive member layer is formed by the method.

As described above, a magnetic iron oxide particle having good charging stability and a photosensitive member on which a clear electrostatic image can be formed have been proposed.

Meanwhile, a transfer material having a smooth surface such as coat paper has started to be used in the market in association with the requests for the increase in speed and the improvement in image quality. In the coat paper, an image printed on the paper is faithfully reproduced, and the quality of the image is improved; for example, the gloss of the image is improved, and the non-uniformity of the gloss is reduced.

However, an image defect such as minute scattering or tailing which is inconspicuous and hence not perceived as a problem on plain paper tends to appear remarkably in the coat paper having a smooth surface.

A possible reason for the foregoing is as described below. The surface of the plain paper has unevenness due to its fibers. Accordingly, even when minute scattering or tailing occurs, the minute scattering or tailing is embedded in a gap between the fibers so as to be of no concern when viewed with the eyes. In the case of the coat paper having a smooth surface, however, even minute scattering remains on the surface so as to be conspicuous.

An additional improvement for obviating an image defect such as minute scattering or tailing is needed in order that image formation may be adapted to a wide variety of transfer materials in the recent trends toward the increase in speed and the improvement in image quality.

Patent Citation 1: JP 2001-2426 A
Patent Citation 2: JP 04-338971 A
Patent Citation 3: JP 2002-207305 A
Patent Citation 4: JP 08-211641 A

DISCLOSURE OF INVENTION

Technical Problem

An object of the present invention is to provide an image-forming method that has solved the above problems. That is, the object of the present invention is to provide an image-forming method in which an image defect such as scattering or tailing is not perceived as a problem over a long time period even in coat paper irrespective of whether image formation is performed under high humidity or low humidity.

Technical Solution

The present invention for solving the above problems relates to an image-forming method, comprising:

charging an electrostatic image bearing member for bearing an electrostatic image;

forming an electrostatic image on the charged electrostatic image bearing member;

developing the electrostatic image with toner to form a toner image;

transferring the toner image on the electrostatic image bearing member with or without mediating an intermediate transferring member onto a transfer material; and fixing the toner image on the transfer material, wherein:

the electrostatic image bearing member is a photosensitive member obtained by sequentially laminating at least photoconductive layer and a surface layer formed of hydrogenated amorphous silicon carbide, and a sum of an atomic density of silicon atoms and an atomic density of carbon atoms is $6.60\times10^{22}$ atoms/cm$^3$ or more; and the toner has at least a binder resin and magnetic iron oxide particles, and the magnetic iron oxide particles contain Fe(2+) at a content of 20.0 mass % or more and 25.0 mass % or less.

Advantageous Effects

According to the present invention, there can be provided an image-forming method and an image-forming apparatus in each of which an image defect such as scattering or tailing is not perceived as a problem over a long time period even in coat paper irrespective of whether image formation is performed under high humidity or low humidity.

EXPLANATION OF REFERENCE

Reference Signs List

Figure 1:
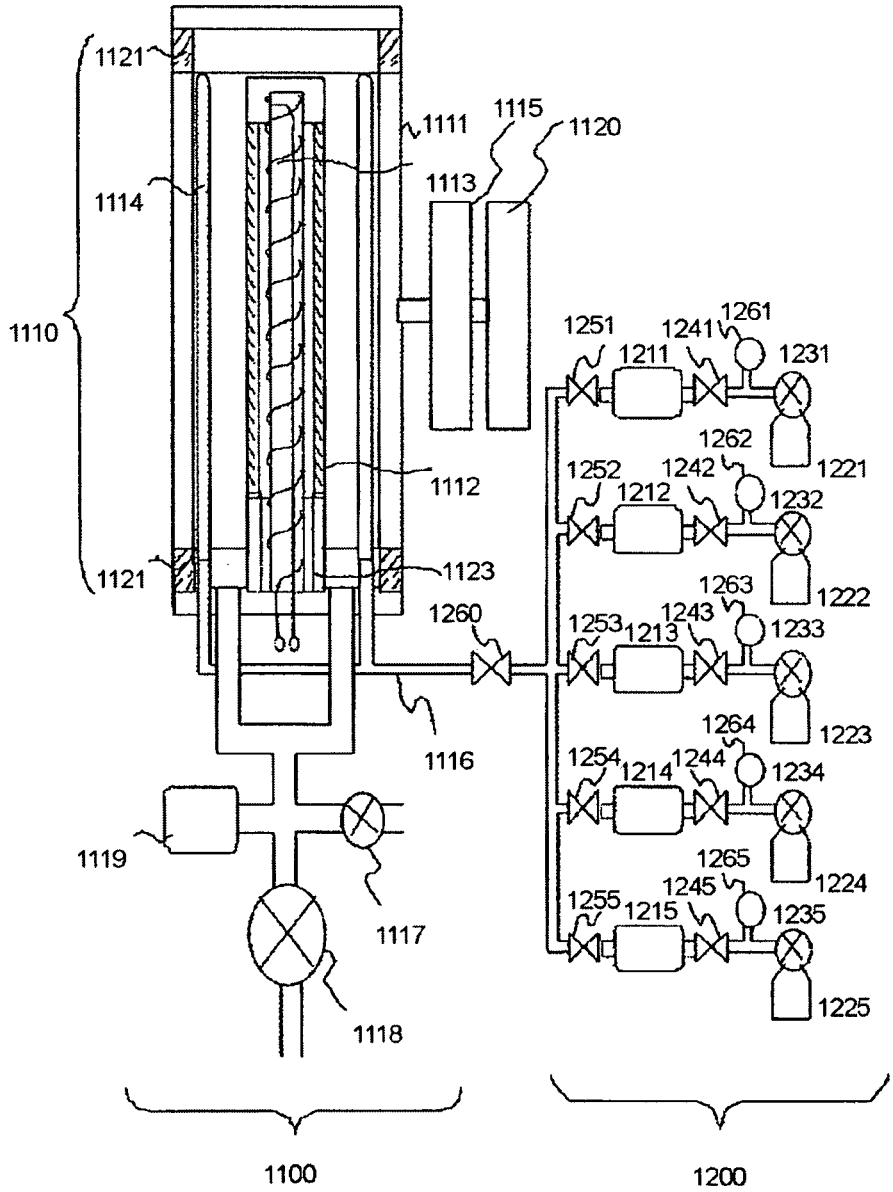
FIG. 1 is a schematic view illustrating an example of a plasma CVD assembly used in the production of a photosensitive member of the present invention.

1100 . . . depositing apparatus
1110 . . . reaction vessel
1111 . . . cathode electrode
1112 . . . conductive substrate
1113 . . . heater for heating conductive substrate
1114 . . . gas introducing pipe
1115 . . . high-frequency matching box
1116 . . . gas piping
1117 . . . leak valve
1118 . . . main-valve
1119 . . . vacuum gauge
1120 . . . high-frequency power source
1121 . . . insulating material
1123 . . . cradle
1200 . . . gas feeding apparatus
1211 to 1215 . . . massflow controller
1221 to 1225 . . . bomb
1251 to 1235 . . . valve
1241 to 1245 . . . inflow valve
1251 to 1255 . . . outflow valve
1260 . . . auxiliary valve
1261 to 1265 . . . pressure regulator
6001 . . . electrophotographic photosensitive member
6002 . . . main charging device
6003 . . . static eliminator
6004 . . . transfer charging device
6005 . . . detach charger
6006 . . . electrostatic latent image means
6007 . . . magnet roller
6008 . . . cleaning blade
6009 . . . cleaner
6010 . . . transfer material
6011 . . . transport means
6012 . . . developing device

BEST MODE FOR CARRYING OUT THE INVENTION

A magnetic iron oxide particle exposed to the surface of toner is expected to serve as a leak point. When a point at which charge is apt to leak is present on a photosensitive member, the charge of the toner leaks to the photosensitive member through the magnetic iron oxide particle. Accordingly, even when the toner has a proper charge amount as a result of friction with a developing sleeve, the charge quantity of the toner becomes insufficient upon transfer of the toner from the photosensitive member onto a recording medium. As a result, the response of the toner to an electric field in a transfer zone weakens, so the toner appears as an image defect such as scattering or tailing at the time of its transfer. The foregoing is considered to be the mechanism via which the scattering of the toner occurs.

In addition, even when the number of leak points on the photosensitive member is small, and a toner image maintaining a proper charge amount can be obtained, the presence of a variation in electric potential of the toner image on the photosensitive member may result in the scattering of the toner to a non-image portion at the time of the transfer.

Accordingly, the leak of the charge of the toner to the photosensitive member must be suppressed, and the electric potential of the toner image at the time of the transfer must be uniformized in order that an image defect such as scattering or tailing may be suppressed.

The inventors of the present invention have found that the above problem can be solved by using a photosensitive member having a surface layer with a predetermined atomic density and a toner containing magnetic iron oxide particles containing a predetermined amount of Fe(2+).

Magnetic iron oxide particles used in the present invention are mainly composed of magnetite. In the present invention, the term "Fe(2+) of the magnetic iron oxide particles" refers to a divalent iron atom attributed to FeO, and the term "Fe(3+) of the magnetic iron oxide particles" refers to a trivalent iron atom attributed to $Fe_2O_3$.

The delivery of charge generated by charging is considered to occur between Fe(2+) and Fe (3+) in the magnetite, and the content of Fe (2+) affects the electrical characteristics of the magnetite. When the magnetic iron oxide particles contain Fe(2+) at a content of 20.0 mass % or more and 25.0 mass % or less, charge exchange in a toner particle and between toner particles may be performed in a particularly efficient fashion. It should be noted that, when an Fe(2+) content of the magnetic iron oxide particles of 20.0 mass % or more and 25.0 mass % or less is converted into an FeO amount, the FeO amount is 25.7 mass % or more and 32.2 mass % or less, which means that the magnetite is in an Fe(2+)-rich state as compared to conventional magnetite. When the Fe(2+) content in the magnetic iron oxide particles falls within the above range, the charging stability of the toner and the responsiveness of the toner to an electric field are improved, whereby the uniformity of the charge of the toner can be maintained even in a state where a toner image is formed on the photosensitive member; on the other hand, the charge of the toner tends to move, so the leak of the charge to the photosensitive member is apt to occur.

In view of the foregoing, a photosensitive member having the following characteristics is used in the present invention in order that the leak of the charge to the photosensitive member may be prevented: the photosensitive member has a surface layer formed of hydrogenated amorphous silicon carbide, and the atomic densities of silicon and carbon atoms in the surface layer are high. To be specific, the photosensitive member is such that the sum of the atomic; density of the silicon atoms and the atomic density of the carbon atoms in the surface layer of the photosensitive member (hereinafter referred to as "Si+C atomic density") is $6.60\times10^{22}$ atoms/$cm^3$ or more. This is because of the following reason.

In an electrophotographic process, a reaction between an ion species produced by a charging step and a carbon atom on the surface of the photosensitive member causes the oxidation and elimination of the carbon atom, so a bond between the carbon atom and a silicon atom is cleaved in some cases. As a result, a dangling bond arises, and an oxidizing substance reacts with the dangling bond, so the a-SiC:H surface layer may be oxidized. The portion that has reacted with the oxidizing substance on the surface of the photosensitive member shows a reduced resistance, so the portion may serve as a leak point for the charge.

When the atomic densities of the silicon and carbon atoms on the surface of the photosensitive member are high, each interatomic distance is short, so a bond between a silicon atom and a carbon atom is hardly cleaved, and the oxidation of the surface of the photosensitive member can be prevented. As a result, the number of leak points occurring on the photosensitive member can be reduced.

The Si+C atomic density is preferably set to 6.81 atoms/$cm^3$ or more in order that the electric potential of the toner image on the photosensitive member may be additionally uniformized. In addition, an upper limit for the Si+C atomic density is $13.0\times10^{22}$ atoms/$cm^3$, which corresponds to a state where an SiC crystal is densified to the largest extent.

Accordingly, as long as such photosensitive member as described above is used, even when a toner having such magnetic iron oxide particles as described above is used, the charge of the toner can be prevented from leaking to the photosensitive member. In addition, in the case where the toner is present on the surface of the photosensitive member after a developing step, even when an excessively charged toner particle exists, excessive charge flows to the photosensitive member, whereby the toner image can be uniformly charged at the time of its transfer. As a result, even in coat paper, an image defect such as scattering or tailing is prevented, and hence a clear image can be obtained.

A ratio of the atomic density of the carbon atoms to the sum of the atomic density of the silicon atoms and the atomic density of the carbon atoms in the a-SiC:H surface layer of the photosensitive member (hereinafter referred to as "C atom ratio") is preferably 0.61 or more and 0.75 or less. As long as the C atom ratio falls within the above range, the surface of the photosensitive member has a moderate resistance, so a clear electrostatic image can be obtained in an additionally stable fashion even under a high-temperature, high-humidity environment. In addition, the photosensitive member shows an expanded band gap, so the exchange of charge between the photosensitive member and the toner can be efficiently performed even under a normal-temperature, low-humidity environment.

In addition, a ratio of the atomic density of hydrogen atoms to the sum of the atomic density of the silicon atoms, the atomic density of the carbon atoms, and the atomic density of the hydrogen atoms in the a-SiC:H surface layer of the photosensitive member (hereinafter referred to as "H atom ratio") is preferably 0.30 or more and 0.45 or less.

As long as the H atom ratio falls within the above range, the optical band gap of the photosensitive member expands, so the sensitivity of the photosensitive member is improved. In addition, the number of structurally weak portions in the a-SiC:H surface layer such as a methyl group each of which causes a strain in a bond between atoms present around it reduces, so the oxidation of the surface of the photosensitive member is prevented.

Methods of measuring the Si+C atomic density, the C atom ratio, and the H atom ratio are described below.

First, a reference electrophotographic photosensitive member in which only a charge injection blocking layer and a photoconductive layer shown in Table 1 are laminated is produced, and a 15-mm square central portion in the longitudinal direction in an arbitrary circumferential direction of the photosensitive member is cut out so that a reference sample is produced. Next, an electrophotographic photosensitive member in which a charge injection blocking layer, a photoconductive layer, and a surface layer are laminated is produced, and then the same cutting as that described above is performed so that a measurement sample is produced. The reference sample and the measurement sample are each subjected to measurement by spectroscopic ellipsometry (manufactured by J.A. Woollam Co., Inc.: High-speed Spectroscopic Ellipsometry M-2000) so that the thickness of the surface layer is determined. Details about a method of measuring the thickness are as described below.

Specific measurement conditions for spectroscopic ellipsometry are as follows: an angle of incidence of 60° 65°, or 70°, a measurement wavelength of 195 nm to 700 nm, and a beam diameter of 1 mm×2 mm.

First, a relationship between the wavelength and each of an amplitude ratio Ψ and a phase difference Δ is determined for the reference sample by spectroscopic ellipsometry at each angle of incidence.

Next, a relationship between the wavelength and each of the amplitude ratio Ψ and the phase difference Δ is determined for the measurement sample by spectroscopic ellipsometry at each angle of incidence in the same manner as in the reference sample while the results of the measurement for the reference sample are used as references.

Then, a relationship between the wavelength and each of the Ψ and Δ at each angle of incidence is determined by calculation with an analytical software WVASE32 manufactured by J.A. Woollam Co., Inc. by using a layer constitution obtained by sequentially laminating the charge injection blocking layer, the photoconductive layer, and the surface layer and having such a roughness layer that a volume ratio between the surface layer and an air layer becomes 8:2 on its outermost surface as a calculation model. Further, the thickness of the surface layer when a mean square error between the relationship between the wavelength and each of the Ψ and Δ determined by the calculation and the relationship between the wavelength and each of the Ψ and Δ determined by the measurement for the measurement sample becomes minimum is calculated, and the resultant value is defined as the thickness of the surface layer.

After the completion of the measurement of the thickness of the surface layer by spectroscopic ellipsometry, the above measurement sample is subjected to the following measurement by Rutherford back scattering spectroscopy (RBS) (manufactured by Nisshin High-Voltage Co., Ltd.: a back scattering measuring apparatus AN-2500): the number of silicon atoms and the number of carbon atoms in the surface layer in the measurement area by RBS are measured. Then, a ratio C/(Si+C) is determined. Next, the atomic density of the silicon atoms, the atomic density of the carbon atoms, and the Si+C atomic density are determined by using the thickness of the surface layer determined by spectroscopic ellipsometry for the number of silicon atoms and the number of carbon atoms determined from the measurement area by RBS.

Simultaneously with RBS, the above measurement sample is subjected to the following measurement by hydrogen forward scattering spectroscopy (HFS) (manufactured by Nisshin High-Voltage Co., Ltd.: a back scattering measuring apparatus AN-2500): the number of hydrogen atoms in the surface layer in the measurement area by HFS is measured. The H atom ratio is determined from the number of hydrogen atoms determined from the measurement area by HFS, and the number of silicon atoms and the number of carbon atoms determined from the measurement area by RBS. Next, the atomic density of the hydrogen atoms is determined by using the thickness of the surface layer determined by spectroscopic ellipsometry for the number of hydrogen atoms determined from the measurement area by HFS.

Specific measurement conditions for RBS and HFS are as follows: $^4He^+$ is used as an incident ion, and an incident energy, an angle of incidence, a sample current, and an incident beam diameter are set to 2.3 MeV, 75°, 35 nA, and 1 mm, respectively, a detector for RBS has a scattering angle of 160° and an aperture diameter of 8 mm, and a detector for HFS has a recoil angle of 30° and an aperture diameter of 8 mm+slit.

Next, an example of a method of producing the photosensitive member used in the present invention is described. FIG. 1 is a view schematically illustrating an example of a photosensitive member depositing assembly based on RF plasma CVD with a high-frequency power source for producing an a-Si-based photosensitive member.

The assembly is roughly constituted of a depositing apparatus 1100 having a reaction vessel 1110, a raw material gas feeding apparatus 1200, and an exhausting apparatus for reducing the pressure in the reaction vessel 1110 (not shown).

A conductive substrate 1112 connected to the ground, a heater 1113 for heating the conductive substrate, and raw material gas introducing pipes 1114 are installed in the reaction vessel 1110 in the depositing apparatus 1100. Further, a high-frequency power source 1120 is connected to a cathode electrode 1111 through a high-frequency matching box 1115.

The raw material gas feeding apparatus 1200 is constituted of: raw material gas bombs 1221 to 1225 containing, for example, $SiH_4$, $H_2$, $CH_4$, NO, and $B_2H_6$; valves 1231 to 1235; pressure regulators 1261 to 1265; inflow valves 1241 to 1245; outflow valves 1251 to 1255; and massflow controllers 1211 to 1215. The gas bombs in which the respective raw material gases are sealed are connected to the raw material gas introducing pipes 1114 in the reaction vessel 1110 through an auxiliary valve 1260.

Next, a method of forming a deposited film with the assembly is described. First, the conductive substrate 1112 that has been degreased and cleaned in advance is installed in the reaction vessel 1110 through a cradle 1123. Next, the exhausting apparatus (not shown) is operated so that the inside of the reaction vessel 1110 is exhausted. While the display of a vacuum gauge 1119 is viewed, power is fed to the heater 1113 for heating the substrate when the pressure in the reaction vessel 1110 reaches a predetermined pressure, for example, 1 Pa or less. Then, the conductive substrate 1112 is heated to a desired temperature, for example, 50° C. to 350° C. In this case, the heating can be performed in an inert gas atmosphere by feeding an inert gas such as Ar or He from the gas feeding apparatus 1200 to the reaction vessel 1110.

Next, gases used in the formation of the deposited film are fed from the gas feeding apparatus 1200 to the reaction vessel 1110. That is, the valves 1231 to 1235, the inflow valves 1241 to 1245, and the outflow valves 1251 to 1255 are opened as required, and flow amount setting is performed with the massflow controllers 1211 to 1215. When the flow rate of each massflow controller becomes stable, while the display of the vacuum gauge 1119 is viewed, a main valve 1118 is manipulated so that the pressure in the reaction vessel 1110 may be adjusted to a desired pressure. Once the desired pressure is obtained, high-frequency power is applied from the high-frequency power source 1120, and at the same time, the high-frequency matching box 1115 is manipulated so that plasma discharge is generated in the reaction vessel 1110. After that, the high-frequency power is immediately adjusted to desired power so that the deposited film is formed.

When the formation of a predetermined deposited film is completed, the application of the high-frequency power is stopped, and the valves 1231 to 1235, the inflow valves 1241 to 1245, the outflow valves 1251 to 1255, and the auxiliary valve 1260 are closed so that the feeding of the raw material gases may be terminated. At the same time, the main valve 1118 is fully opened so that the inside of the reaction vessel 1110 may be exhausted to a pressure of 1 Pa or less.

Thus, the formation of the deposited film is completed; when multiple deposited films are formed, the respective layers have only to be formed by repeating the above procedure again. A joining region can also be formed by changing the flow rate, pressure, and the like of a raw material gas into conditions for forming a photoconductive layer within a certain time period.

After the formation of all deposited films has been completed, the main valve 1118 is closed, and an inert gas is introduced into the reaction vessel 1110 to return the pressure in the vessel to atmospheric pressure. After that, the conductive substrate 1112 is taken out.

In the electrophotographic photosensitive member used in the present invention, a surface layer of a membrane structure having high atomic densities is formed by increasing the atomic densities of the silicon and carbon atoms of which a-SiC is constituted as compared to those of the surface layer of a conventionally known electrophotographic photosensitive member. As described above, when the a-SiC:H surface layer having high atomic densities of silicon and carbon atoms of the present invention is produced, a balance between the amount of the gases and the high-frequency power is generally of importance, though the degree of importance varies depending on conditions at the time of the production of the surface layer. The amount of the gases to be fed to the reaction vessel is desirably small, the high-frequency power is desirably high, the pressure in the reaction vessel is desirably high, and furthermore, the temperature of the conductive substrate is desirably high.

First, they amount of the gases to be fed into the reaction vessel is reduced, and the high-frequency power is increased, whereby the decomposition of the gases can be promoted. Accordingly, a carbon atom feeder (such as $CH_4$) which is harder to decompose than a silicon atom feeder (such as $SiH_4$) can be efficiently decomposed. As a result, an active species containing a small amount of hydrogen atoms is produced, whereby the a-SiC:H surface layer having high atomic densities of silicon and carbon atoms can be formed.

In addition, increasing the pressure in the reaction vessel lengthens the retention time of each raw material gas fed into the reaction vessel. Further, increasing the temperature of the conductive substrate lengthens the surface migration distance of an active species that has arrived at the conductive substrate, whereby an additionally stable bond can be formed between a silicon atom and a carbon atom.

The magnetic iron oxide particles used in the present invention are produced by a general solution reaction of magnetite. To be specific, the magnetic iron oxide particles can be obtained by oxidizing ferrous hydroxide slurry obtained by mixing and neutralizing an aqueous solution of a ferrous salt with an alkali solution. The magnetic iron oxide particles having an Fe(2+) content of 20.0 mass % or more and 25.0 mass % or less used in the present invention can be obtained by performing drying under a nonoxidative atmosphere at the time of their production or by performing a reducing reaction treatment or an oxidizing reaction in multiple stages; a production method involving performing an oxidizing reaction in multiple stages is particularly preferable from the viewpoint of the stability of the magnetic iron oxide particles over time.

The Fe(2+) content in the magnetic iron oxide particles is measured in conformity with a ferrous oxide determination method in JIS M8213 (1983). To be specific, 25 g of a sample are added to 3.8 liters of deionized water, and the mixture is stirred at a stirring speed of 200 revolutions per minute while its temperature is kept at 40° C. in a water bath. Then, 1,250 ml of an aqueous solution of hydrochloric acid (deionized water) prepared by dissolving 424 ml of a reagent grade hydrochloric acid reagent (having a concentration of 35%) are added to the resultant slurry to dissolve the sample completely. The solution is filtrated with a 0.1-μm membrane filter, and the filtrate is collected. A sample is prepared by adding 75 ml of deionized water to 25 ml of the filtrate, and sodium diphenylamine sulfonate is added as an indicator to the sample. Then, the sample is subjected to oxidation-reduction titration with a 0.05-mol/l solution of potassium dichromate, and a titer is determined by defining the amount of potassium dichromate in which the sample is colored violet as an endpoint. The Fe(2+) content (mass %) in the magnetic iron oxide particles is determined from the titer.

A ratio X of the amount of Fe(2+) to the total amount of Fe of the magnetic iron oxide particles dissolved until an Fe element dissolution ratio reaches 10 mass % is preferably 34% or more and 50% or less.

The Fe element dissolution ratio is an indicator representing position information about the magnetic iron oxide particles. That is, a state where the Fe element dissolution ratio is 0 mass % is a state where the magnetic iron oxide particles are not dissolved at all; a state where the Fe element dissolution ratio is 100 mass % is a state where the magnetic iron oxide particles are completely dissolved. That is, the position information meant by the time point when the Fe element dissolution ratio is 100 mass % means the center of each particle.

In other words, the total amount of Fe dissolved until the Fe element dissolution ratio reaches 10 mass % means the total amount of Fe present in the range of up to 10 mass % from the surfaces of the magnetic iron oxide particles. In addition, the ratio X is a ratio of the amount of Fe(2+) to the total amount of Fe.

In other words, a state where the ratio X of the amount of Fe(2+) to the total amount of Fe dissolved until the Fe element dissolution ratio reaches 10 mass % is 34% or more and 50% or less means that particularly the vicinities of the surfaces of the magnetic iron oxide particles are in Fe(2+)-rich states as compared to conventional magnetite. When the vicinities of the surfaces of the magnetic iron oxide particles are in Fe(2+)-rich states, charge exchange between Fe(2+) and Fe (3+) is performed in an additionally efficient fashion, and the charging stability of a toner containing the magnetic iron oxide particles and the responsiveness of the toner to an electric field are improved. As a result, the exchange of minute charge between the toner and the surface of the photosensitive member easily occurs.

When the ratio X of the amount of Fe(2+) is less than 34%, the charge exchange between Fe(2+) and Fe (3+) near the surfaces does not occur efficiently in some cases, so the charging stability of the surfaces of the magnetic iron oxide particles tends to be low; particularly under a normal-temperature, low-humidity environment, charge exchange between the toner and the photosensitive member may hardly occur. However, when the ratio X of the amount of Fe(2+) is 34% or more, the surfaces of the magnetic iron oxide particles show uniform charging stability, so the charge exchange between the toner and the photosensitive member occurs effectively. Therefore, the ratio X of the amount of Fe(2+) is preferably set to 34% or more.

Although magnetic iron oxide particles having a ratio X of the amount of Fe(2+) in excess of 50% can be produced by employing a vapor-phase reduction method, the magnetic iron oxide particles thus produced are not practical because of their instability in the air.

In order that magnetic iron oxide particles having a ratio X of the amount of Fe(2+) to the total amount of Fe dissolved until the Fe element dissolution ratio reaches 10 mass % of 34% or more and 50% or less may be obtained, the oxidizing reaction at the time of the production of the particles is performed in multiple stages.

To be specific, the following procedure is preferably adopted: the amount in which an oxidizing gas is blown is gradually reduced in association with the progress of the oxidation of ferrous hydroxide so that the amount in which the gas is blown at the final stage may be small. Performing such multistage oxidizing reaction as described above enables one to increase the amount of Fe(2+) on the surfaces of the iron oxide particles selectively. When air is used as the oxidizing gas, the amount in which air is blown is preferably controlled, for example, as described below for slurry containing 100 moles of an iron element. It should be noted that the amount in which air is blown is gradually reduced in the following ranges:

the amount is 10 to 80 liters/min, or preferably 10 to 50 liters/min until 50% of the molecules of ferrous hydroxide are turned into an iron oxide;

the amount is 5 to 50 liters/min, or preferably 5 to 30 liters/min until more than 50% and 75% or less of the molecules of ferrous hydroxide are turned into an iron oxide;

the amount is 1 to 30 liters/min, or preferably 2 to 20 liters/min until more than 75% and 90% or less of the molecules of ferrous hydroxide are turned into an iron oxide; and the amount is 1 to 15 liters/min, or particularly 2 to 8 liters/min at the stage where more than 90% of the molecules of ferrous hydroxide are turned into an iron oxide.

A method of calculating the ratio X of the amount of Fe(2+) to the total amount of Fe dissolved until the Fe element dissolution ratio reaches 10 mass % is described below.

First, 25 g of the magnetic iron oxide particles as a sample are added to 3.8 liters of deionized water, and the mixture is stirred at a stirring speed of 200 revolutions per minute while its temperature is kept at 40° C. in a water bath. Then, 1,250 ml of an aqueous solution of hydrochloric acid (deionized water) prepared by dissolving 424 ml of a reagent grade hydrochloric acid reagent (having a concentration of 35%) are added to the resultant slurry to dissolve the magnetic iron oxide particles under stirring. During a time period commencing on the initiation of the dissolution and ending on the time point when the magnetic iron oxide particles are completely dissolved so that the mixture may become transparent, 50 ml of the aqueous solution of hydrochloric acid are sampled every 10 minutes together with the magnetic iron oxide particles dispersed in the aqueous solution. Immediately after that, the aqueous solution is filtrated with a 0.1-μm membrane filter, and the filtrate is collected. The amount of an Fe element is determined by using 25 ml of the collected filtrate with an ICP. Then, the Fe element dissolution ratio (mass %) of the magnetic iron oxide particles is calculated from the following equation for each collected sample.

Fe element dissolution ratio (mass %)={Iron element concentration (mg/l) in collected sample}/{Iron element concentration (mg/l) at time of complete dissolution}×100 [Num 1]

In addition, an Fe(2+) concentration is measured by using the remaining 25 ml of the collected filtrate. A sample is prepared by adding 75 ml of deionized water to the 25-ml filtrate, and sodium diphenylamine sulfonate is added as an indicator to the sample. Then, the sample is subjected to oxidation-reduction titration with a 0.05-mol/l solution of potassium dichromate, and a titer is determined by defining the amount of potassium dichromate in which the sample LS colored violet as an endpoint. The Fe(2+) concentration (mg/l) is calculated from the titer.

A ratio of the amount of Fe(2+) at the time point when each sample is collected is calculated from the following equation by using the iron element concentration in the sample determined by the above-mentioned method and the Fe(2+) concentration determined from the sample at the same time point.

Ratio of amount of Fe(2+) (%)={Fe(2+)concentration (mg/l) in collected sample}/{Iron element concentration (mg/l) in collected sample}×100 [Num 2]

Then, the Fe element dissolution ratio and the ratio of the amount of Fe(2+) thus obtained are plotted for each collected sample, and an "Fe element dissolution ratio-versus-ratio of amount of Fe(2+)" graph is created by smoothly connecting the respective points. The ratio X (%) of the amount of Fe(2+) to the total amount of Fe dissolved until the Fe element dissolution ratio reaches 10 mass % is determined by using the graph.

In addition, when a ratio of the amount of Fe(2+) to the total amount of Fe in the remaining 90 mass % excluding the amount of Fe of the magnetic iron oxide particles of the present invention dissolved until the Fe element dissolution ratio reaches 10 mass % is represented by Y, a ratio (X/Y) is preferably larger than 1.00 and 1.30 or less.

The ratio (X/Y) represents an Fe(2+) abundance ratio between the surfaces and insides of the magnetic iron oxide particles. When the ratio X/Y falls within the above range, the amount of Fe(2+) in the particles is proper, so the charging stability of the toner containing the magnetic iron oxide particles is improved, and an image formed with the toner can be additionally clear.

A state where the ratio X/Y is equal to or smaller than 1.00 in the magnetic iron oxide particles having a large Fe(2+) content means that the amount of Fe(2+) near the surfaces of the particles is small. That is, the following tendency arises: effective charge exchange between Fe(2+) and Fe (3+) near the surfaces hardly occurs. Accordingly, setting the ratio X/Y to more than 1.00 improves a balance between the amount of Fe(2+) near the surfaces and the amount of Fe(2+) in the particles, and enables the effective charge exchange even on the surfaces, whereby the toner can obtain additionally good charging stability.

On the other hand, a state where the ratio X/Y is larger than 1.30 means that the amount of Fe(2+) near the surfaces of the particles is large. Although such magnetic iron oxide particles can be produced by employing a vapor-phase reduction method, the magnetic iron oxide particles thus produced are not practical because of their instability in the air.

A method of calculating the Fe(2+) content ratio (X/Y) is described below.

The ratio X (%) is determined by the above-mentioned method.

The ratio Y (%) of the amount of Fe(2+) to the total amount of Fe in the remaining 90 mass % excluding the amount of Fe dissolved until the Fe element dissolution ratio reaches 10 mass % is calculated by the following method. That is, a difference between the iron element concentration (mg/l) when the magnetic iron oxide particles are completely dissolved and the iron element concentration (mg/l) when the Fe element dissolution ratio is 10 mass % obtained in the above-mentioned measurement of the X is defined as an iron element concentration (mg/l) in the remaining 90 mass %. Meanwhile, a difference between the Fe(2+) concentration (mg/l)

when the magnetic iron oxide particles are completely dissolved and the Fe(2+) concentration (mg/l) when the Fe element dissolution ratio is 10 mass % obtained in the above-mentioned measurement of the X is defined as an Fe(2+) concentration (mg/l) in the remaining 90 mass %. The ratio Y (%) of the amount of Fe(2+) to the total amount of Fe in the remaining 90 mass % excluding the amount of Fe dissolved until the Fe element dissolution ratio reaches 10 mass % is calculated from the following equation by using the values thus obtained.

Y (%)={(Fe(2+) concentration at time of complete dissolution)−(Fe(2+) concentration when iron element dissolution ratio is 10 mass %)}/{(Iron element concentration at time of complete dissolution)−(Iron element concentration when iron element dissolution ratio is 10 mass %)}×100 [Num 3]

The ratio (X/Y) is calculated by using the ratios X (%) and Y (%) calculated as described above.

The magnetic iron oxide particles are used in an amount of preferably 20 parts by mass or more and 150 parts by mass or less, or more preferably 50 parts by mass or more and 120 parts by mass or less with respect to 100 parts by mass of the binder resin.

In addition, the magnetic iron oxide particles have an average primary particle diameter of preferably 0.10 μm or more and 0.30 μm or less, or more preferably 0.10 μm or more and 0.20 μm or less. Controlling the average primary particle diameter of the magnetic iron oxide particles within the above range allows uniform dispersion of the magnetic powder in toner particles, thereby additionally improving the charging stability of the toner.

The magnetic iron oxide particles are preferably produced by oxidizing ferrous hydroxide slurry obtained by mixing and neutralizing an aqueous solution of a ferrous salt with an alkali solution.

A water-soluble salt such as ferrous sulfate or ferrous chloride is used as the ferrous salt. A water-soluble silicate (such as sodium silicate) is added to and mixed in the ferrous salt so that the content of the water-soluble silicate in terms of Si is 0.20 mass % or more and 1.50 mass % or less with respect to the final total amount of the magnetic iron oxide particles.

Next, the resultant aqueous solution of the ferrous salt containing a silicon component is mixed and neutralized with the alkali solution so that the ferrous hydroxide slurry is produced.

Here, an aqueous solution of an alkali metal hydroxide such as an aqueous solution of sodium hydroxide or of potassium hydroxide can be used as the alkali solution.

The amount of the alkali solution upon production of the ferrous hydroxide slurry has only to be adjusted depending on a required shape of each magnetic iron oxide particle. To be specific, spherical particles are obtained when the amount is adjusted so that the pH of the ferrous hydroxide slurry is less than 8.0; hexahedral particles are obtained when the amount is adjusted so that the pH is 8.0 or more and 9.5 or less; or octahedral particles are obtained when the amount is adjusted so that the pH exceed 9.5.

In order that the magnetic iron oxide particles is obtained from the ferrous hydroxide slurry thus obtained, an oxidizing reaction is performed while an ordinary oxygen-containing gas, or preferably air is blown into the slurry. The oxidizing reaction is performed in multiple stages; to be specific, the oxidizing reaction is performed in multiple stages while the flow rate of air is appropriately adjusted in accordance with the growth of the magnetic iron oxide particles. When such multistage oxidizing reaction is performed, the magnetic iron oxide particles are in Fe(2+)-rich states as compared to conventional magnetite, and the amount of Fe(2+) on the surfaces can be selectively increased.

Next, an aqueous solution of sodium silicate and an aqueous solution of aluminum sulfate are simultaneously charged into the resultant slurry of the magnetic iron oxide particles as core particles, and the pH of the mixture is adjusted to 5 or more and 9 or less. Thus, slurry containing the following magnetic iron oxide particles is obtained: a coat layer containing silicon and aluminum is formed on the surface of each of the particles.

The amount of silicon of which the coat layers are formed in terms of Si is preferably adjusted to 0.05 mass % or more and 0.50 mass % or less with respect to the final total amount of the magnetic iron oxide particles. The amount of aluminum of which the coat layers are formed in terms of Al is preferably adjusted to 0.05 mass % or more and 0.50 mass % or less with respect to the final total amount of the magnetic iron oxide particles.

The resultant slurry of the magnetic iron oxide particles each having the coat layer formed on its surface is subjected to filtration, washing, drying, and a pulverization treatment, whereby the magnetic iron oxide particles are obtained.

Examples of the binder resin used in the toner include the following: a vinyl-based resin, a styrene-based resin, a styrene-based copolymer resin, a polyester resin, a polyol resin, a polyvinyl chloride resin, a phenol resin, a natural resin-modified phenol resin, a natural resin-modified maleic acid resin, an acrylic resin, a methacrylic resin, a polyvinyl acetate, a silicone resin, a polyurethane resin, a polyamide resin, a furan resin, an epoxy resin, a xylene resin, polyvinyl butyral, a terpene resin, a coumarone-indene resin, and a petroleum-based resin. Of those, a styrene-based copolymer resin, a polyester resin, a hybrid resin in which a polyester resin and a vinyl-based resin are mixed or partially reacted are preferably used.

A releasing agent (wax) may be used as required in order to impart releasing property to the toner. As the wax, hydrocarbon-based waxes such as low-molecular weight polyethylene, low-molecular weight polypropylene, a microcrystalline wax, and a paraffin wax are preferably used in terms of easiness of dispersion in the toner particles and high releasing performance. Two or more kinds of waxes may be used in combination as required. Examples thereof include the following:

oxides of aliphatic hydrocarbon-based waxes such as a polyethylene oxide wax and block copolymers thereof; waxes mainly composed of fatty acid esters such as a carnauba wax, a sasol wax, and a montanic acid ester wax; and partially or wholly deacidified fatty acids such as a deacidified carnauba wax. The examples further include the following: straight-chain saturated fatty acids such as palmitic acid, stearic acid, and montanic acid; unsaturated fatty acids such as bras sidle acid, eleostearic acid, and parinaric acid; saturated alcohols such as stearyl alcohol, aralkyl alcohol, behenyl alcohol, carnaubyl alcohol, ceryl alcohol, and melissyl alcohol; long-chain alkyl alcohols; polyhydric alcohols such as sorbitol; fatty acid amides such as linoleic amide, oleic amide, and lauric amide; saturated fatty acid bis amides such as methylene bis stearamide, ethylene bis capramide, ethylene bis lauramide, and hexamethylene bis stearamide; unsaturated fatty acid amides such as ethylene bis oleamide, hexamethylene bis oleamide, N,N'-dioleyl adipamide, and N,N-dioleyl sebacamide; aromatic bis amides such as m-xylene bis stearamide and N,N-distearyl isophthalamide; aliphatic metal salts (what are generally referred to as metallic soaps) such as calcium stearate, calcium laurate, zinc stearate, and magnesium stearate; waxes obtained by grafting aliphatic hydrocarbon-based waxes with vinyl-based monomers such as styrene and acrylic acid; partially esterified compounds of fatty acids and polyhydric alcohols such as behenic monoglyceride; and methyl ester compounds each having a hydroxyl group obtained by the hydrogenation of vegetable oil.

Specific examples of waxes that can be used include the following: Biscol (registered trademark) 330-P, 550-P, 660-P, and TS-200 (Sanyo Chemical Industries, Ltd.); Hiwax 400P, 200P, 1002, 4102, 420P, 3202, 2202, 210P, and 110P (Mitsui Chemicals, Inc.); Sasol H1, H2, C80, C105, and 077 (Sasol Wax Co.); HNP-1, HNP-3, HNP-9, HNP-10, HNP-11, and HNP-12 (NIPPON SEIRO CO., LTD); Unilin (registered trademark) 350, 425, 550, and 700, Unisid (registered trademark) 350, 425, 550, and 700 (TOYO-PETROLITE); and a haze wax, a beeswax, a rice wax, a candelilla wax, and a carnauba wax (CERARICA NODA Co., Ltd.).

The time at which the release agent (wax) is added is appropriately selected from the known methods. For example, the release agent may be added at the time of melting and kneading during toner production, or may be added at the time of production of the binder resin. In addition, one kind of those release agents may be used alone, or two or more kinds of them may be used in combination.

The release agent is preferably added in an amount of 1 part by mass or more and 20 parts by mass or less with respect to 100 parts by mass of the binder resin. As long as the amount falls within the above range, the dispersing performance of the release agent in the toner is good, and the release agent can provide a sufficient releasing effect. A charge control agent can be used in the toner to stabilize the triboelectric charging performance of the toner. A charge control agent is generally incorporated into toner particles in an amount of preferably 0.1 part by mass or more to 10.0 parts by mass or less, or more preferably 0.1 part by mass or more to 5.0 parts by mass or less with respect to 100 parts by mass of the binder resin, although the amount varies depending on, for example, the kind of the charge control agent and the physical properties of other materials constituting the toner particles. Known examples of such charge control agent include one for controlling toner to be negatively charged and one for controlling toner to be positively charged. One kind or two or more kinds of various charge control agents can be used depending on the kind and applications of the toner.

Examples of charge control agents for controlling the toner to be negatively charged include the following: organometallic complexes (monoazo metal complexes, acetylacetone metal complexes); and metal complexes or metal salts of aromatic hydroxycarboxylic acids or aromatic dicarboxylic acids. Further, the examples of charge control agents for controlling toner to be negatively charged include: aromatic monocarboxylic and polycarboxylic acids, and metal salts and anhydrates thereof; esters; and phenol derivatives such as bisphenol. Of those, a metal complex or metal salt of an aromatic hydroxycarboxylic acid capable of providing stable charging performance is particularly preferably used.

Examples of charge control agents for controlling the toner to be positively charged include the following: nigrosin and modified products of nigrosin with aliphatic metal salts; quaternary ammonium salts such as tributylbenzyl ammonium-1-hydroxy-4-naphthosulfonate and tetrabutyl ammonium tetrafluoroborate, and analogs thereof; onium salts such as phosphonium salts and lake pigments of the salts; triphenyl methane dyes and lake pigments of the dyes (as lake agents, phosphotungstic acid, phosphomolybdic acid, phosphotungsten molybdic acid, tannic acid, lauric acid, gallic acid, ferricyanic acid, and ferrocyanide are exemplified); and metal salts of higher aliphatic acids. In the present invention, one kind of them may be used alone, or two or more kinds of them may be used in combination. Of those, a nigrosin-based compound and a quaternary ammonium salt are particularly preferably used as the charge control agent for controlling toner to be positively charged.

Specific examples of a charge control agent that can be used include the following: Spilon Black TRH, T-77, T-95, and TN-105 (Hodogaya Chemical Co., Ltd.); and BONTRON (trademark) S-34, S-44, E-88, and E-89 (Orient Chemical Industries, Co., Ltd.). Examples of a charge control agent for positive charging include the following: TP-302 and TP-415 (Hodogaya Chemical Co., Ltd.); BONTRON (registered trademark) N-01, N-04, N-07, and P-51 (Orient Chemical Industries, Co. Ltd.); and Copy Blue PR(Clariant).

A charge control resin can also be used, and can be used in combination with any one of the above-mentioned charge control agents.

A silica fine powder is preferably externally added to the toner particles for improving the charging stability, developing performance, flowability, and durability of the toner.

The silica fine powder preferably has a specific surface area by a BET method based on nitrogen adsorption in the range of 30 $m^2/g$ or more (particularly preferably 50 $m^2/g$ or more to 400 $m^2/g$ or less) because such silica fine powder provides a good result. The silica fine powder is desirably used in an amount of 0.01 part by mass or more and 8.00 parts by mass or less, or preferably 0.10 part by mass or more and 5.00 parts by mass or less with respect to 100 parts by mass of the toner.

The BET specific surface area of the silica fine powder can be calculated by employing a BET multipoint method with, for example, a specific surface area-measuring apparatus AUTOSORB 1 (manufactured by Yuasa Ionics Inc.), GEMINI 2360/2375 (manufactured by Micromeritics Instrument Corporation), or Tristar 3000 (manufactured by Micromeritics Instrument Corporation) while causing a nitrogen gas to adsorb to the surface of the silica fine powder.

In addition, the silica fine powder is preferably treated with a treatment agent for making the powder hydrophobic or controlling the triboelectric charging performance of the toner as required. Examples of the treatment agent include unmodified silicone varnishes, various modified silicone varnishes, unmodified silicone oils, various modified silicone oils, silane coupling agents, silane compounds each having a functional group, and other organic silicon compounds. The silica fine powder may be treated with a combination of two or more kinds of treatment agents.

Another external additive may be added as required to the toner. Examples of the external additive include resin fine particles and inorganic fine particles which work as a charging aid agent, a conductivity-imparting agent, a flowability-imparting agent, a caking-preventing agent, a release agent used in fixation of a heat roller, a lubricant, a polishing agent, or the like.

Examples of the lubricant include polyethylene fluoride powder, a zinc stearate powder, and a polyvinylidene fluoride powder. Of those, polyvinylidene fluoride powder is preferred.

In addition, examples of the polishing agent include a cerium oxide powder, a silicon carbide powder, and a strontium titanate powder. Of those, strontium titanate powder is preferable.

Examples of the flowability-imparting agent include a titanium oxide powder and aluminum oxide powder. Of those, a substance subjected to hydrophobic treatment is preferable.

Examples of the conductivity-imparting agent include a carbon black powder, a zinc oxide powder, an antimony oxide powder.

In addition, a small amount of white fine particles and black fine particles having antipolarity may be used as a developing performance improving agent.

The toner can be obtained by the following methods: sufficiently mixing a binder resin, a colorant, any other additive, and the like by using a mixer such as a Henschel mixer or a ball mill; melting and kneading the mixture by using a heat kneader such as a heat roll, a kneader, or an extruder, and after the cooling solidification, subjecting the resultant to pulverization and classification treatment to obtain toner particles; and sufficiently mixing silica fine particles with the toner particles by using a mixer such as a Henschel mixer to obtain a toner.

Examples of mixers include the following: a Henschel mixer (manufactured by Mitsui Mining Co., Ltd.); a Super mixer (manufactured by Kawata); Ribocorn (manufactured by Okawara Corporation); a Nauta mixer, Turbulizer, and Cyclomix (manufactured by Hosokawa Micron Corporation); a Spiral pin mixer (manufactured by Pacific Machinery and Engineering Co., Ltd.); and a LÖDIGE mixer (manufactured by Matsubo Corporation). Examples of kneaders include the following: a KRC kneader (manufactured by Kurimoto, Ltd.); a Buss co-kneader (manufactured by Buss); a TEM extruder (manufactured by Toshiba Machine Co., Ltd.); a TEX biaxial kneader (manufactured by Japan Steel Works Ltd.); a PCM kneader (manufactured by Ikegai); a Three-roll mill, a Mixing roll mill, and kneader (manufactured by Inoue Manufacturing Co., Ltd.); Kneadex (manufactured by Mitsui Mining Co., Ltd.); an MS pressure kneader and a Kneader-ruder (manufactured by Moriyama Manufacturing Co., Ltd.); and a Banbury mixer (manufactured by Kobe Steels, Ltd.) Examples of pulverizers include the following: a Counter jet mill, a Micronjet, and an Inomizer (manufactured by Hosokawa Micron Corporation); an IDS mill and a PJM jet pulverizer (manufactured by Nippon Pneumatic Mfg, Co., Ltd.); a Cross jet mill (manufactured by Kurimoto, Ltd.); Urumax (manufactured by Nisso Engineering Co., Ltd.); an SK Jet O Mill (manufactured by Seishin Enterprise Co., Ltd.); a Kryptron system (manufactured by Kawasaki Heavy Industries); a Turbo mill (manufactured by Turbo Kogyo Co., Ltd.) and a Super rotor (manufactured by Nisshin Engineering Inc.) Examples of classifiers include the following: a Classiel, a Micron classifier, and a Spedic classifier (manufactured by Seishin Enterprise Co., Ltd.); a Turbo classifier (manufactured by Nisshin Engineering Inc.); a Micron separator, a Turboplex (ATP), and a TSP separator (manufactured by Hosokawa Micron Corporation); an Elbow jet manufactured by Nittetsu Mining Co., Ltd.); a Dispersion separator (manufactured by Nippon Pneumatic Mfg, Co., Ltd.); and a YM microcut (manufactured by Yasukawa Shoji). Examples of sieving devices to be used for sieving coarse particles include the following: an Ultrasonic (manufactured by Koei Sangyo Co., Ltd.); Resonasieve Gyrosifter (manufactured by Tokuju Corporation); a Vibrasonic system (manufactured by Dalton Corporation); a Soniclean (manufactured by Shintokogio Ltd.); a Turbo screener (manufactured by Turbo Kogyo Co., Ltd.); Microsifter (manufactured by Makino mfg Co., Ltd.); and a circular vibrating screen.

Figure 2:
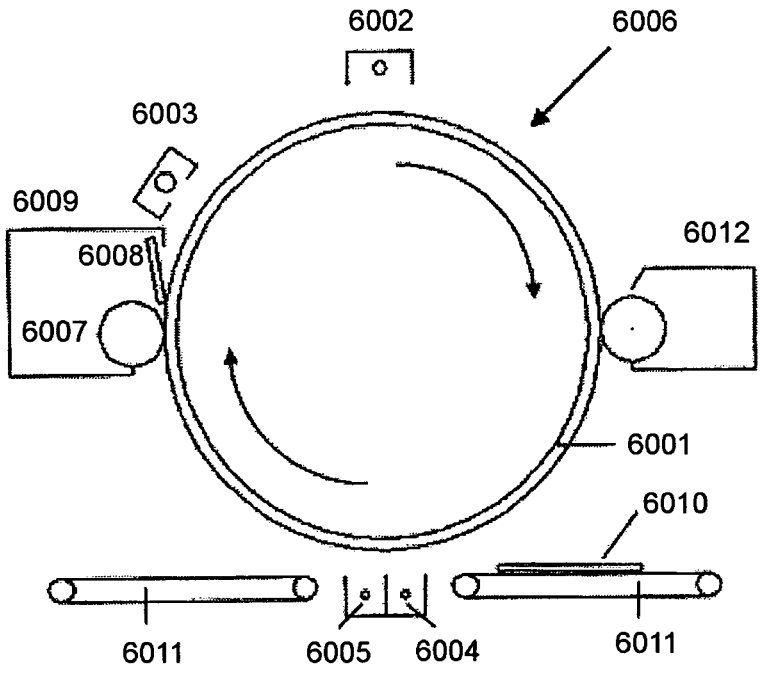
FIG. 2 is an outline sectional view of an image-forming apparatus.

An image-forming method with an image-forming apparatus using an a-Si photosensitive member as an electrostatic image bearing member for bearing an electrostatic image is described with reference to FIG. 2. First, a photosensitive member 6001 is rotated, and its surface is uniformly charged by a main charging device 6002. After that, the surface of the photosensitive member is exposed to light from electrostatic latent image means (exposure means) 6006 so that an electrostatic latent image is formed on the surface of the photosensitive member. Then, the electrostatic latent image is developed with toner fed from a developing device 6012. As a result, a toner image is formed on the surface of the photosensitive member. Then, the toner image is transferred onto a transfer material 6010 by a transfer charging device 6004, and the toner image on the transfer material is fixed by a fixing unit (not shown). In FIG. 2, although only an embodiment in which the toner image on the photosensitive member is transferred without mediating an intermediate transferring member onto the transfer material is disclosed, another embodiment in which the toner image on the photosensitive member is initially transferred to the intermediate transferring member and secondly the toner image on the intermediate transferring member is transferred onto the transferring material is also preferable.

The toner remaining on the surface of the photosensitive member after the transfer of the toner image is removed by a cleaner 6009. After that, the surface of the electrophotographic photosensitive member is exposed to light so that the residual carrier at the time of the formation of the electrostatic latent image in the electrophotographic photosensitive member is eliminated. Continuous image formation is performed by repeating the series of processes.

EXAMPLES

Production Example of Photosensitive Member A-1 Having a-SiC:H Surface Layer A positively charged a-Si photosensitive member was produced with a plasma treating assembly using a high-frequency power source having a frequency in an RF band illustrated in FIG. 1 on a cylindrical substrate (cylindrical aluminum substrate having a diameter of 80 mm, a length of 358 mm, and a thickness of 3 mm and subjected to a mirror finish treatment) under the conditions shown in Table 1 below. In this case, a charge injection blocking layer, a photoconductive layer, and a surface layer were formed in the stated order. It should be noted that the symbol "*" in Table 1 represents a variable value. High-frequency power, an $SiH_4$ flow rate, and a $CH_4$ flow rate at the time of the production of the surface layer were set to the conditions shown in Film Formation Conditions No. 1 of Table 2 below.

Production Examples of a-Sic Photosensitive Members A-2 to A-9

Photosensitive Members A-2 to A-9 were each produced in the same manner as in Photosensitive Member A-1 except that high-frequency power, an $SiH_4$ flow rate, and a $CH_4$ flow rate at the time of the production of the surface layer were set to the conditions shown in any one of Film Formation Conditions Nos. 2 to 9 of Table 2.

TABLE 1

| | Charge injection blocking layer | Photoconductive layer | Surface layer |
|---|---|---|---|
| Kinds and flow rates of gases | | | |
| $SiH_4$[mL/min (normal)] | 350 | 450 | * |
| $H_2$[mL/min (normal)] | 750 | 2,200 | |

TABLE 1-continued

| | Charge injection blocking layer | Photoconductive layer | Surface layer |
|---|---|---|---|
| $B_2H_6$[ppm] (with respect to $SiH_4$) | 1,500 | 1 | |
| NO[mL/min (normal)] | 10 | | |
| $CH_4$[mL/min (normal)] | | | * |
| Internal pressure [Pa] | 40 | 80 | 80 |
| High-frequency power [W] | 400 | 800 | * |
| Substrate temperature [° C.] | 260 | 260 | 290 |
| Thickness [μm] | 3 | 25 | 0.5 |

TABLE 2

| | Film Formation Conditions No. | | | | | | | | |
|---|---|---|---|---|---|---|---|---|---|
| | 1 | 2 | 3 | 4 | 5 | 6 | 7 | 8 | 9 |
| $SiH_4$ [mL/min (normal)] | 26 | 35 | 26 | 26 | 35 | 26 | 26 | 26 | 20 |
| $CH_4$ [mL/min (normal)] | 400 | 190 | 500 | 150 | 190 | 450 | 360 | 500 | 600 |
| High-frequency power [W] | 800 | 750 | 800 | 850 | 700 | 950 | 1,000 | 750 | 750 |

Each of Electrophotographic Photosensitive Members A-1 to A-9 produced by the above methods was evaluated for its Si+C atomic density, H atom ratio, and C atom ratio under the above-mentioned conditions. Table 3 shows the results.

TABLE 3

| Photosensitive Member | C atom ratio | Si atomic density ($\times 10^{22}$ atoms/cm$^3$) | C atomic density ($\times 10^{22}$ atoms/cm$^3$) | Si + C atomic density ($\times 10^{22}$/cm$^3$) | H atom ratio | H atomic density ($\times 10^{22}$ atoms/cm$^3$) |
|---|---|---|---|---|---|---|
| A-1 | 0.73 | 1.84 | 4.97 | 6.81 | 0.41 | 4.73 |
| A-2 | 0.61 | 2.99 | 4.68 | 7.67 | 0.31 | 3.45 |
| A-3 | 0.75 | 1.65 | 4.95 | 6.60 | 0.43 | 4.98 |
| A-4 | 0.67 | 2.63 | 5.35 | 7.98 | 0.25 | 2.66 |
| A-5 | 0.59 | 3.12 | 4.49 | 7.61 | 0.32 | 3.58 |
| A-6 | 0.76 | 1.74 | 5.49 | 7.23 | 0.34 | 3.72 |
| A-7 | 0.76 | 1.78 | 5.64 | 7.42 | 0.29 | 3.03 |
| A-8 | 0.74 | 1.68 | 4.80 | 6.48 | 0.45 | 5.30 |
| A-9 | 0.77 | 1.45 | 4.85 | 6.30 | 0.46 | 5.37 |

Production Example of Magnetic Iron Oxide Particles B-1

First, 50 liters of an aqueous solution of ferrous sulfate containing 2.0 mol/l of Fe(2+) were prepared by using ferrous sulfate. In addition, 10 liters of an aqueous solution of sodium silicate containing 0.23 mol/l of Si (4+) were prepared by using sodium silicate, and were then added to the aqueous solution of ferrous sulfate. Next, 42 liters of a 5.0-mol/l aqueous solution of NaOH were mixed in the mixed aqueous solution under stirring, whereby ferrous hydroxide slurry was obtained. The pH and temperature of the ferrous hydroxide slurry were adjusted to 12.0 and 90° C., respectively, and an oxidizing reaction was performed by blowing air into the slurry at 30 liters/min until 50% of the molecules of ferrous hydroxide were turned into magnetic iron oxide particles. Next, air was blown into the slurry at 20 liters/min until 75% of the molecules of ferrous hydroxide were turned into magnetic iron oxide particles. Next, air was blown into the slurry at 10 liters/min until 90% of the molecules of ferrous hydroxide were turned into magnetic iron oxide particles Further, the oxidizing reaction was completed by blowing air into the slurry at 5 liters/min at the time point when a ratio of magnetic iron oxide particles exceeded 90%. Thus, slurry containing core particles of octahedral shapes was obtained.

Then, 94 ml of an aqueous solution of sodium silicate (containing 13.4 mass % of Si) and 288 ml of an aqueous solution of aluminum sulfate (containing 4.2 mass % of Al) were simultaneously charged into the resultant slurry containing the core particles. After that, the temperature of the slurry was adjusted to 80° C., and the pH of the slurry was adjusted to 5 or more and 9 or less with dilute sulfuric acid, whereby a coat layer containing silicon and aluminum was formed on the surface of each core particle. The resultant magnetic iron oxide particles were filtrated, dried, and pulverized by ordinary methods, whereby Magnetic Iron Oxide Particles B-1 were obtained. Table 5 shows the physical properties of Magnetic Iron Oxide Particles B-1.

Production Examples of Magnetic Iron Oxide Particles B-2 to B-6

Magnetic Iron Oxide Particles B-2 to B-6 were each obtained in the same manner as in the production example of Magnetic Iron Oxide Particles B-1 except that production conditions were adjusted as shown in Table 4. Table 5 shows the physical property values of Magnetic Iron Oxide Particles B-2 to B-6.

It should be noted that the respective stages of the amount in which air is blown in Table 4 represent the following states.

First stage: the production ratio of the magnetic iron oxide particles is 0% or more and 50% or less.

Second stage: the production ratio of the magnetic iron oxide particles is more than 50% and 75% or less.

Third stage: the product ion ratio of the magnetic iron oxide particles is more than 75% and 90% or less.

Fourth stage: the production ratio of the magnetic iron oxide particles is more than 90% and up to 100%.

Production Example of Magnetic Iron Oxide Particles B-7

First, 5 liters of a 0.14-mol/l aqueous solution of titanyl sulfate were mixed in 50 liters of a 2-mol/l aqueous solution of ferrous sulfate under the following conditions: a pH of 1 and a temperature of 50° C. Then, the mixture was sufficiently stirred. The aqueous solution of ferrous sulfate containing the titanate and 43 liters of a 5-mol/l aqueous solution of sodium hydroxide were mixed, whereby ferrous hydroxide slurry was obtained. The pH of the ferrous hydroxide slurry was kept at 12, and an oxidizing reaction was performed by blowing air into the slurry at 85° C. The resultant slurry containing magnetite particles was filtrated, washed, dried, and pulverized by ordinary methods, whereby Magnetic Iron Oxide Particles B-7 were obtained. Table 5 shows the physical property values of Magnetic Iron Oxide Particles B-7 thus obtained.

TABLE 4

| Production conditions for magnetic iron oxide particles | | | | | | | | | | |
|---|---|---|---|---|---|---|---|---|---|---|
| | Core particle reaction | | | | | | | | Coating treatment | |
| | Aqueous solution of water-soluble silicate | | Flow rate at which air is blown (L/min) | | | | | | Aqueous solution of sodium silicate | Aqueous solution of aluminum sulfate |
| | Concentration (mol/l) | Liquid amount (L) | First stage | Second stage | Third stage | Fourth stage | Liquid temperature (° C.) | Reaction pH | Liquid amount (g) | Liquid amount (g) |
| Production Example B-1 | 0.23 | 10 | 30 | 20 | 10 | 5 | 90 | 12 | 120 | 380 |
| Production Example B-2 | 0.28 | 10 | 30 | 20 | 10 | 5 | 90 | 13 | 120 | 380 |
| Production Example B-3 | 0.3 | 10 | 20 | 13 | 7 | 3 | 90 | 12.5 | 120 | 380 |
| Production Example B-4 | 0.47 | 10 | 10 | 5 | 4 | 3 | 90 | 13.5 | 120 | 380 |
| Production Example B-5 | 0.22 | 10 | 30 | 20 | 12 | 5 | 90 | 13.5 | 120 | 380 |
| Production Example B-6 | 0.8 | 10 | 30 | 25 | 15 | 5 | 90 | 10.5 | 20 | 40 |

Production Example of Magnetic Iron Oxide Particles B-8

A predetermined amount (0.77 liter) of an aqueous solution of ferrous chloride (having a concentration of 328 g/l) was charged into a reaction vessel having a volume of 4 liters, and 0.18 liter of an aqueous solution of sodium hydroxide (having a concentration of 328 g/l) and 0.16 liter of an aqueous solution of sodium carbonate (having a concentration of 328 g/l) were added to the aqueous solution while the aqueous solution was stirred. Next, the temperature of the mixture was increased to 90° C., and then black fine particles were produced by blowing air into the mixture at a rate of 3 liters/min. An aqueous solution of sodium hydroxide was added to the suspension to adjust the pH of the suspension to 13. After that, water glass (0.13 liter of an aqueous solution having a concentration of 10 g/l in terms of Si) was added to the mixture, and the whole was sufficiently stirred. Next, 0.99 liter of an aqueous solution of ferric chloride (having a concentration of 328 g/l) was added to the resultant so that an Si compound might be coprecipitated with iron on the black fine particles. The reaction product was filtrated and dried, whereby Magnetic Iron Oxide Particles B-8 each containing the Si compound were obtained. Table 5 shows the physical property values of Magnetic Iron Oxide Particles B-8 thus obtained.

TABLE 5

| Magnetic Iron Oxide Particles | Amount of Fe (2+) | Ratio X | X/Y |
|---|---|---|---|
| B-1 | 22 | 35 | 1.16 |
| B-2 | 22.3 | 38 | 1 |
| B-3 | 23.6 | 44 | 1.28 |
| B-4 | 24.8 | 49 | 1.03 |
| B-5 | 22.1 | 36 | 0.94 |
| B-6 | 20.8 | 34 | 0.92 |
| B-7 | 20.3 | 28 | 0.91 |
| B-8 | 16.3 | 20 | 0.61 |

Production Example of Resin (C-1)

| | |
|---|---|
| Propylene oxide adduct of bisphenol A (the average number of added mole: 2.2 mol) | 34.0 mol % |
| Ethylene oxide adduct of bisphenol A (the average number of added mole: 2.2 mol) | 19.5 mol % |
| Isophthalic acid | 23.5 mol % |
| n-dodecenyl succinic acid | 13.5 mol % |
| Trimellitic acid | 9.5 mol % |

The above monomer and dibutyl tin oxide are each added in an amount of 0.03 part by mass with respect to all acid components under a nitrogen stream, and reacted while being stirred at 22.0° C. for 6 hours, whereby Polyester Resin (C-1) was obtained.

Production Example of Toner 1

| | |
|---|---|
| Polyester Resin (C-1) | 100 parts by mass |
| Magnetic Iron Oxide Particles B-1 | 75 parts by mass |
| Fisher Tropsch Wax | 4 parts by mass |
| Charge control agent (Structural Formula 1 below) | 2 parts by mass |

[Chem 1]

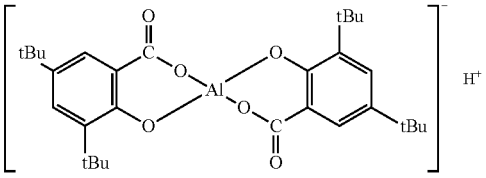

Structural Formula 1

The above-mentioned materials were premixed by using a Henschel mixer. After that, the mixture was melted and kneaded by using a biaxial kneading extruder.

The resultant kneaded product was cooled and coarsely ground using a hammer mill. After that, the coarsely ground product was ground by using a jet mill, and the resultant finely ground powder was classified by using a multi-division classifier utilizing a Coanda effect, whereby toner particles having a weight average particle size (D4) of 6.8 μm and negative triboelectric property were obtained. 0.8 part by mass of a hydrophobic silica fine powder (BET 140 $m^2/g$, obtained by subjecting 30 parts by mass of hexamethyldisilazane (HMDS) and 10 parts bymass of dimethyl silicone oil with respect to 100 parts by mass of a parent body to hydrophobic treatment) and 30 parts bymass of strontium titanate (number average particle size: 1.2 μm) were externally added to and mixed with 100 parts by mass of the toner particles, and the mixture was sieved by using a mesh having an aperture of 150 μm, whereby Toner 1 having negative triboelectric property was obtained.

Production Examples of Toners 2 to 9

Toners 2 to 9 were each obtained in the same manner as in the production example of Toner 1 except that magnetic iron oxide particles were changed as shown in Table 6.

TABLE 6

| Toner No. | Magnetic Iron Oxide Particles |
|---|---|
| Toner 1 | B-1 |
| Toner 2 | B-2 |
| Toner 3 | B-3 |
| Toner 4 | B-4 |
| Toner 5 | B-5 |
| Toner 6 | B-6 |
| Toner 7 | B-7 |
| Toner 8 | B-8 |

Example 1

A commercially available copying machine (iR-5075 manufactured by Canon Inc.) was reconstructed to have a process speed of 600 mm/sec, and the reconstructed apparatus was used in the following evaluation. An "Office Planner SK 64 g Paper manufactured by Canon Inc." (hereinafter referred to as "plain paper") and an "OK Topcoat 85 g Paper manufactured by Oji paper Co., Ltd." (hereinafter referred to as "coat paper") were each used as evaluation paper. Photosensitive Member A-1 was attached to the evaluation machine, and Toner 1 was loaded into the evaluation machine. Then, a durability test was performed by copying test charts each having a print percentage of 5% on 100,000 sheets of each of the plain paper and the coat paper by continuous, one-side paper passing under each of a normal-temperature, normal-humidity environment (23° C., 50% RH), a normal-temperature, low-humidity environment (23° C., 5% RH), and a high-temperature, high-humidity environment (30° C., 80% RH). An image defect such as the scattering or tailing of a character or line was evaluated by visual observation on the basis of the following criteria. Table 7 shows the results of the evaluation.

A (very good) Scattering, tailing, or the like does not occur at all.

B (good) Scattering, tailing, or the like slightly occurs when carefully observed.

C (normal) Scattering, tailing, or the like occurs, but does not affect image quality.

D (somewhat bad) Scattering, tailing, or the like occurs to affect image quality to some extent.

E (bad) Scattering, tailing, or the like remarkably occurs.

Examples 2 to 15

Evaluation was performed in the same manner as in Example 1 except that a photosensitive member and a toner were combined as shown in Table 7. Table 7 shows the results of the evaluation.

TABLE 7

| | | | Image quality evaluation | | | | | | | | | | | |
|---|---|---|---|---|---|---|---|---|---|---|---|---|---|---|
| | | | Normal temperature and low humidity | | | | Normal temperature and normal humidity | | | | High temperature and high humidity | | | |
| | | Photo- | Plain paper | | Coat paper | | Plain paper | | Coat paper | | Plain paper | | Coat paper | |
| | Toner No. | sensitive Member No. | Initial stage | After duration | Initial stage | After duration | Initial stage | After duration | Initial stage | After duration | Initial stage | After duration | Initial stage | After duration |
| Example 1 | 1 | A-1 | A | A | A | A | A | A | A | A | A | A | A | A |
| Example 2 | 1 | A-2 | A | A | A | A | A | A | A | A | A | A | A | A |
| Example 3 | 1 | A-3 | A | A | A | A | A | A | A | A | A | A | A | B |
| Example 4 | 1 | A-4 | A | A | A | B | A | A | A | B | A | A | A | B |
| Example 5 | 1 | A-5 | A | A | A | A | A | A | A | B | A | A | B | B |
| Example 6 | 1 | A-6 | A | A | A | A | A | A | A | B | A | A | B | B |

TABLE 7-continued

| | | | Image quality evaluation | | | | | | | | | | | |
|---|---|---|---|---|---|---|---|---|---|---|---|---|---|---|
| | | | Normal temperature and low humidity | | | | Normal temperature and normal humidity | | | | High temperature and high humidity | | | |
| | | Photo- | Plain paper | | Coat paper | | Plain paper | | Coat paper | | Plain paper | | Coat paper | |
| | Toner No. | sensitive Member No. | Initial stage | After duration | Initial stage | After duration | Initial stage | After duration | Initial stage | After duration | Initial stage | After duration | Initial stage | After duration |
| Example 7 | 1 | A-7 | A | A | B | B | A | A | B | B | A | A | B | B |
| Example 8 | 2 | A-1 | A | A | A | A | A | A | A | B | A | A | A | B |
| Example 9 | 3 | A-1 | A | A | A | A | A | A | A | B | A | A | A | B |
| Example 10 | 4 | A-1 | A | A | A | A | A | A | A | B | A | B | A | B |
| Example 11 | 5 | A-1 | A | B | A | B | A | A | A | B | A | A | A | B |
| Example 12 | 6 | A-1 | A | B | B | C | A | B | B | B | A | B | B | B |
| Example 13 | 7 | A-1 | A | B | B | C | A | B | B | C | A | B | B | B |
| Example 14 | 6 | A-7 | B | C | B | C | B | B | B | B | B | B | B | B |
| Example 15 | 7 | A-7 | B | B | B | C | B | C | B | C | B | B | B | B |
| Comparative Example 1 | 7 | A-8 | B | C | B | C | C | D | C | D | C | D | C | D |
| Comparative Example 2 | 7 | A-9 | C | C | C | C | C | D | C | D | C | D | D | E |
| Comparative Example 3 | 8 | A-7 | C | D | D | E | C | D | D | E | C | D | C | D |
| Comparative Example 4 | 8 | A-9 | D | E | D | E | D | E | D | E | D | E | D | E |

The invention claimed is:

1. An image-forming method, comprising the steps of:

charging an electrostatic image bearing member for bearing an electrostatic image;

forming an electrostatic image on the charged electrostatic image bearing member;

developing the electrostatic image with toner to form a toner image;

transferring the toner image on the electrostatic image bearing member with or without mediating an intermediate transferring member onto a transfer material; and fixing the toner image on the transfer material, wherein:

the electrostatic image bearing member is a photosensitive member obtained by sequentially laminating at least a photoconductive layer and a surface layer formed of hydrogenated amorphous silicon carbide, and a sum of an atomic density of silicon atoms and an atomic density of carbon atoms in the surface layer is $6.60\times10^{22}$ atoms/$cm^3$ or more; and the toner has at least a binder resin and magnetic iron oxide particles, and the magnetic iron oxide particles contain Fe(2+) at a content of 20.0 mass % or more and 25.0 mass % or less.

2. An image-forming method according to claim 1, wherein a ratio X of an amount of Fe(2+) to a total amount of Fe of the magnetic iron oxide particles dissolved until an Fe element dissolution ratio reaches 10 mass % is 34% or more and 50% or less.

3. An image-forming method according to claim 2, wherein, when a ratio of an amount of Fe(2+) to a total amount of Fe in the remaining 90 mass % excluding the amount of Fe of the magnetic iron oxide particles dissolved until the Fe element dissolution ratio reaches 10 mass % is represented by Y, a ratio (X/Y) is larger than 1.00 and 1.30 or less.

4. An image-forming method according to claim 1, wherein a ratio of the atomic density of the carbon atoms to the sum of the atomic density of the silicon atoms and the atomic density of the carbon atoms in the surface layer is 0.61 or more and 0.75 or less.

5. An image-forming method according to claim 1, wherein a ratio of the atomic density of the hydrogen atoms to the sum of the atomic density of the silicon atoms, the atomic density of the carbon atoms, and the atomic density of the hydrogen atoms in the surface layer is 0.30 or more and 0.45 or less.

6. An image-forming apparatus, comprising:

an electrostatic image bearing member for bearing an electrostatic image;

a charging device for charging the electrostatic image bearing member;

electrostatic latent image means for forming an electrostatic image on the charged electrostatic image bearing member;

a developing device for developing the electrostatic image with toner to form a toner image;

a transfer charging device for transferring the toner image on the electrostatic image bearing member onto a transfer material; and a fixing unit for fixing the toner image on the transfer material, wherein:

the electrostatic image bearing member is a photosensitive member having a photoconductive layer and a surface layer formed of hydrogenated amorphous silicon carbide, and a sum of an atomic density of silicon atoms and an atomic density of carbon atoms in the surface layer is $6.60\times10^{22}$ atoms/$cm^3$ or more; and the toner has at least a binder resin and magnetic iron oxide particles, and the magnetic iron oxide particles contain Fe(2+) at a content of 20.0 mass % or more and 25.0 mass % or less.

* * * * *